United States Patent [19]

Loomis

[11] 4,133,427

[45] Jan. 9, 1979

[54] ARROW PACKAGE

[76] Inventor: Thomas H. Loomis, Box 445, Martin, S. Dak. 57551

[21] Appl. No.: 837,874

[22] Filed: Sep. 29, 1977

[51] Int. Cl.[2] ..... B65D 85/20

[52] U.S. Cl. ..... 206/317; 206/315 R; 206/372; 206/383; 206/443; 206/602; 206/579; 206/820; 206/485

[58] Field of Search ..... 206/315 R, 317, 371, 206/372, 382, 383, 482, 485, 602, 820, 443, 579; 150/52 H; 273/106.5 R

[56] References Cited

U.S. PATENT DOCUMENTS

| | | | |
|---|---|---|---|
| 1,670,204 | 5/1928 | Moore | 206/372 |
| 2,135,134 | 11/1938 | Ehlers | 206/485 |
| 2,285,214 | 6/1942 | Lisle | 206/383 |
| 2,964,166 | 12/1960 | Lehner et al. | 206/579 |
| 3,266,625 | 8/1966 | Hardman | 206/602 |
| 3,286,831 | 11/1966 | Giberstein | 206/602 |
| 3,301,386 | 1/1967 | Carter | 206/315 R |
| 3,399,009 | 8/1968 | Slade | 206/315 |
| 4,023,678 | 5/1977 | Fiedler | 206/485 |

FOREIGN PATENT DOCUMENTS

| | | | |
|---|---|---|---|
| 61246 | 5/1968 | Fed. Rep. of Germany | 206/485 |
| 1007194 | 10/1965 | France | 206/485 |

*Primary Examiner*—William Price
*Assistant Examiner*—Bruce H. Bernstein
*Attorney, Agent, or Firm*—Littlepage, Quaintance, Murphy, Richardson and Webner

[57] ABSTRACT

A package of arrows for shipment and display is constructed from a sheet of corrugated board, which is cut out to provide openings and formed with flaps having potential apertures cut therein for holding the arrows. The arrows are mounted on the sheet by hinging the flaps up at an angle to the sheet and forcing the tips of the arrows through the potential apertures, with the string notches held by fitting over an edge of an opening.

2 Claims, 5 Drawing Figures

ARROW PACKAGE

NATURE OF INVENTION

The package of this invention holds a number of arrows for display to attract attention, for ready inspection, and for protection from damage when stacked for storage or shipment. Casual or surreptitious removal is restricted, although each arrow may be readily taken from the package by simple manipulation. The package is constructed from a single sheet of inexpensive material, which may be made into separable sections or panels so that a group of arrows on a panel may be detached from the whole package.

The fibrous sheet material such as corrugated board, from which this package is formed, provides a stiff, substantial base divided into a plurality of sections or panels. Flaps bent out of the plane of each panel have aligned, potential apertures formed by cuts which allow the arrows to be pushed through the flaps and held by frictionally engaging the edges of the cuts, some tips of the arrows having shoulders which resist removal through the apertures. Each end of a panel has an opening cut out providing an edge to receive the string notches of the arrows and space for the feathers. This structure is simple and inexpensive to manufacture, holds the arrows for display and for inspection, restricts quick, casual removal of the arrows, and also acts to protect the arrows when a number of packages are stacked.

DRAWINGS

The specific structure of this invention is illustrated in the following drawings, in which.

GENERAL DESCRIPTION

Figure 1:
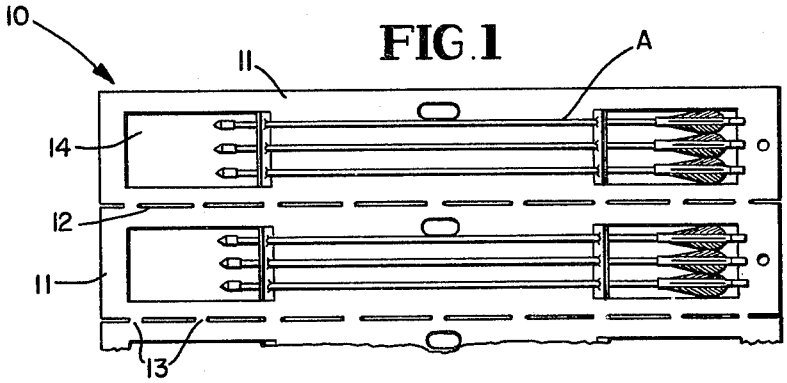
FIG. 1 shows a plan view of the package of the invention, partly broken away.
Figure 2:
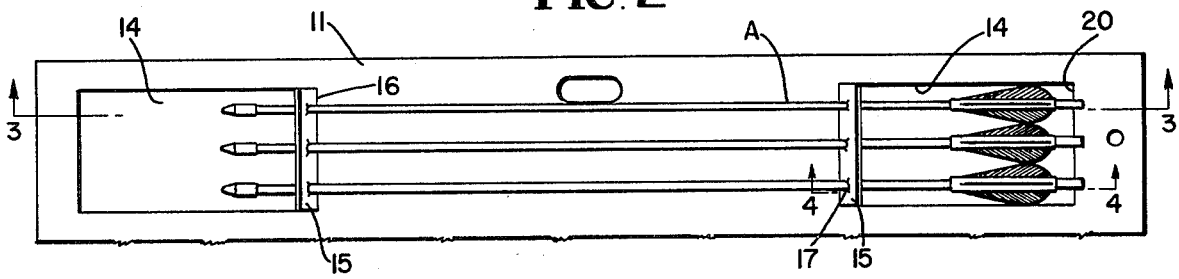
FIG. 2 shows a plan view of one panel of the package of FIG. 1.
Figure 3:
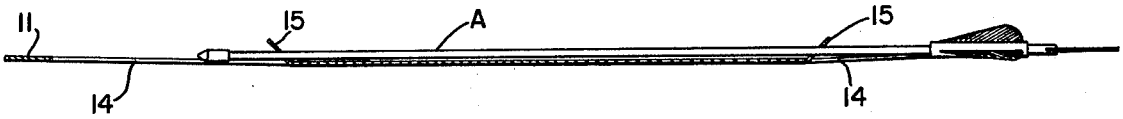
FIG. 3 shows a sectional view of the package, taken on line 3—3 of FIG. 2.
Figure 4:
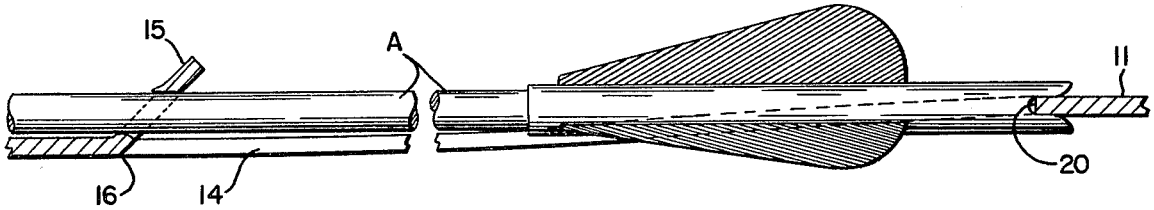
FIG. 4 shows a fragmentary sectional view on line 4—4 of FIG. 2.
Figure 5:
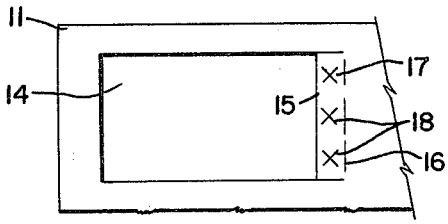
FIG. 5 shows a fragmentary plan view of a flap shown in FIG. 2.

The package structure 10 for holding a number of arrows is composed of a plurality of panels 11 of a relatively stiff sheet material, such as corrugated board, joined together along longitudinal separation lines 12 formed by spaced tabs 13 integral with the panels.

Each panel 11 may hold several articles, such as arrows A. A large opening 14 is cut out of each end of the panel, and on the end of the opening 14 adjacent the central portion of the panel a transverse flap 15 is integrally connected along the line 16, the material being pressed or scored to weaken the material along the line, constituting an integral hinge connecting the flap to the panel.

The two longitudinally spaced flaps 15 are provided with longitudinally aligned potential apertures 17. At each central point of the potential aperture the material is slit along intersecting cuts 18 . The flaps 15, when raised on hinges 16, will be punctured by the arrows A forced through aligned potential apertures 17, thereby pushing the material outwardly and frictionally engaging the arrows by the edges of the cuts 18.

The arrows are held in position in the apertures by fitting their string notches over the edge 20 of opening 14 adjacent the end of the panel. The feathers of the arrows adjacent the string notches are positioned in the large openings and are protected against flattening by the raised flaps 15.

The package 10 is formed initially as a flat sheet with the opening 14 cut out, the flaps 15 with their ends severed and joined to the sheet along pressed or scored lines 16 for ease of bending, and the potential apertures in the flaps formed by the cuts 18. A plurality of panels 11 are joined along their longitudinal edges by the separation lines 12 having rupturable, spaced tabs 13. The package of arrows is made by bending up the flaps 15, forcing the tips of the arrows A through aligned potential apertures 17 and then retracting the arrows to fit the string notches over the edge 20 of opening 14. The shoulders on some tips act to engage the edges of cuts 18 and resist withdrawal of the arrows.

The packages may be stacked for packing and shipping, the flaps 15 being of sufficient height to prevent flattening or substantial distortion of the feathers on the ends of the arrows. The arrows are displayed effectively in the package, and may be directly inspected without removal from the package. Surreptitious removal from the package is unlikely because of the frictional resistance to withdrawing an arrow as a result of the punctured form of aperture and the shoulder on some of the tips, and the necessity for moving the notches from the edge of the opening in the panel. To dispense a lesser number of arrows than the full package, one or more panels may be separated as required. The same structure may be adapted to other similar articles, as will be apparent from the description.

I claim:

1. A package of a plurality of arrows, each of said arrows having a pointed tip at one end forming a shoulder at its junction with the body of said arrow, a string notch at the other end, and feathers adjacent said other end, said package comprising a stiff, flat sheet having a plurality of longitudinal, corrugated board panels joined along longitudinal edges by weakened separation lines formed by spaced tabs connecting the adjacent panels, each panel having large rectangular openings adjacent its opposite ends with transverse outer edges adjacent the ends of said panel, transverse flaps along the opposite inner ends of said openings formed by severing their ends from said panel and connected to said panel by weakened, transverse lines to form integral hinged connections for raising said flaps at an angle to said panel, said flaps having a plurality of potential apertures aligned along longitudinal lines of said panel spaced inwardly from the edges of said flaps, each potential aperture being formed by cuts through said flap, intersecting at a point at the center of said potential aperture, said flaps being raised at an angle to said panel, said arrows passing through said aligned apertures of said flaps by forcing their pointed tips substantially perpendicularly to the flaps through the cuts forming the apertures with their cut edges engaging said arrows, said shoulders on said tips of said arrows resisting removal of said arrows through said apertures, the string notches on the other ends of said arrows fitting over the outer edge of the rectangular opening adjacent the end of the panel, said raised flaps with the arrows in position protecting the feathers from being flattened when packages with the arrows are stacked, said panels being readily separated along the separation lines by rupturing said tabs, thereby forming a plurality of packages of lesser numbers of arrows.

2. A package of a plurality of arrows comprising a panel formed from a sheet of stiff, fibrous material, said panel being formed with a rectangular opening adjacent one end having a transverse outer edge, two transverse, longitudinally spaced flaps having their ends severed from said panel and hinged to said panel along weakened, transverse lines and raised at an angle to said panel, said flaps having a plurality of potential apertures spaced from their edges, the apertures in said flaps being aligned longitudinally of said panel, each of said potential apertures being formed by cuts inwardly of the edge of the flap and intersecting at the center of said aperture, a plurality of arrows passing theough said aligned apertures, each arrow having a pointed tip on one end with a shoulder at its junction with the body of said arrow to force the arrow through said aligned apertures, the cut edges of said apertures frictionally engaging said arrows and resisting removal of said pointed tips with their shoulders through the apertures, said arrows having string notches at their opposite ends which receive the transverse edge of the rectangular opening to retain said arrows in said apertures, said arrows having feathers adjacent said string ends and said flaps with said apertures providing for stacking said panels without flattening said feathers.

* * * * *